73-667 SR
12/25/79 XR 4,180,458

United States Patent [19] [11] 4,180,458
Shahan [45] Dec. 25, 1979

[54] VIBRATORY SCREEN HAVING NOISE LEVEL REDUCTION BY ISOLATION

[75] Inventor: James E. Shahan, Bolingbrook, Ill.

[73] Assignee: Allis-Chalmers Corporation, Milwaukee, Wis.

[21] Appl. No.: 12,883

[22] Filed: Feb. 16, 1979

[51] Int. Cl.[2] ..... B07B 1/42

[52] U.S. Cl. ..... 209/326; 209/365 B; 73/667; 366/128; 248/560

[58] Field of Search ..... 209/365 B, 366, 326, 209/367, 331–333, 339, 341, 342, 344, 364; 267/136–137, 141; 188/1 B; 366/31, 128; 181/119, 121; 248/559, 560, 603–604; 198/767, 770; 73/663, 667

[56] References Cited

U.S. PATENT DOCUMENTS

| | | | |
|---|---|---|---|
| 2,144,382 | 1/1939 | Lincoln et al. | 209/329 |
| 2,212,550 | 8/1940 | Parks | 209/326 |
| 2,353,492 | 7/1944 | O'Connor | 366/112 |
| 2,729,332 | 1/1956 | Gruner | 209/329 |
| 3,029,947 | 4/1962 | Roubal | 209/326 |
| 3,030,098 | 4/1962 | Roubal | 267/153 |
| 3,468,418 | 9/1969 | Renner | 209/315 |
| 4,076,197 | 2/1978 | Dochterman | 248/604 |

*Primary Examiner*—Robert Halper
*Assistant Examiner*—Jon Hokanson
*Attorney, Agent, or Firm*—Lee H. Kaiser

[57] ABSTRACT

A relatively quiet vibrating screen has a rotatable eccentric mass drive supported on the screen body by isolator mounts which transmit vibratory forces at shaker frequency unrestrained to the screen body and attenuate forces at higher harmonics of shaker frequency that would otherwise excite wall panels of the screen body into resonance, thereby reducing the noise level of the screen.

8 Claims, 5 Drawing Figures

VIBRATORY SCREEN HAVING NOISE LEVEL REDUCTION BY ISOLATION

BACKGROUND OF THE INVETNION

Exposure of workers in the material processing industry to excessive noise is of primary consideration to plant operators, particularly because of MESA regulations. For example, a room in a coal preparation plant may contain six vibrating screens and two pumps and have a sound level of 98 dBA, which is well above the MESA-permitted 90 dBA, 8-hour limit. As a consequence the plant operator must either purchase equipment which results in a sound level no more than 90 dBA or purchase standard equipment having a higher noise level such as 98 dBA and modify worker routines to limit the exposure time of the worker to the higher noise level. Accordingly it is an object of this invention to provide a quieter vibrating screen, the noise level of which is reduced in comparison to prior art devices.

It is well known to freely support a vibratory screen body from a stationary support by resilient rubber shear mounts such as disclosed in U.S. Pats. Nos. 2,212,550; 2,729,332; 3,029,947 and 3,030,098 to permit a large amplitude of vibration in the desired direction while vibrationally isolating the screen body from the stationary support so that it will vibrate essentially as a free mass system, but such resilient mounting does not solve the problem of high levels of radiated noise from the vibrating screen.

It is also taught by such patents as U.S. Pat. No. 2,353,492 and U.S. Pat. No. 3,468,418 to resiliently support a rotatable eccentric mass drive mechanism on a freely floating screen body through rubber shear springs whose natural vibratory frequency, or spring rate approximates the operating frequency of the drive mechanism for the purpose of increasing the amplitude of vibration, or throw of the screen body. Further, such patents as German Pat. No. 975,330 disclose a vibrating screen device wherein a counterbalance mass is resiliently connected to the freely floating screen body through rubber shear mounts whose natural vibratory frequency is approximately equal to the operating frequency of a rotatable eccentric mass drive for the purpose of increasing the throw of the screen body. Still further, it is known from such patents as U.S. Pat. No. 3,089,582 to mount a rotatable eccentric mass drive mechanism on a freely floating screen body through rubber shear spring mounts to define a resonant spring-weight system wherein the vibratory forces transverse to the desired direction are absorbed in torsion by the shear springs whereas forces in the desired direction to move the screen body are transmitted in shear by the rubber mounts to thereby increase the throw of the screen body. However, none of such resilient mounting systems result in a vibrating screen having a substantially lower sound level.

It is a specific object of the invention to provide a vibrating screen with means for isolating harmonics of the shaking frequency from the screen body while transmitting the vibratory forces from the drive mechanism at the fundamental shaker frequency unrestrained to the screen body, thereby minimizing noise which would otherwise radiate from the side wall and end wall panels of the screen body as a result of such panels being excited at the harmonic frequencies. Particularly it is an object of the invention to provide a vibrating screen with a constant frequency rotatable eccentric mass shaker drive and having means for resiliently mounting the shaker drive on the screen body which transmits vibratory forces at the constant shaker frequency unrestrained to the screen body and substantially attenuates vibratory forces at frequencies which are harmonics of the shaker frequency and would, in the absence of such resilient mounting means, radiate noise by exciting the wall panels of the screen body.

A vibrating screen in accordance with the invention has a freely floating screen body for moving particulate material, rotatable eccentric mass drive means for vibrating the screen body at a substantially constant shaker frequency which is substantially higher than the natural vibration frequency of the screen body, and means for resiliently mounting the drive means on the screen body so that vibratory forces emanating from the drive means at approximately the shaker frequency are transmitted unrestrained to the screen body and vibratory forces above the shaker frequency are substantially attenuated, said resilient mounting means constituting substantially the sole connection between the drive means and the screen body and the natural vibrating frequency of the resilient mounting means being approximately equal to the constant shaker frequency divided by 2.

Other objects and advantages will appear from a detailed description of the invention, one embodiment of which will be described as illustrated in the accompanying drawing wherein.

DETAILED DESCRIPTION

Figure 1:
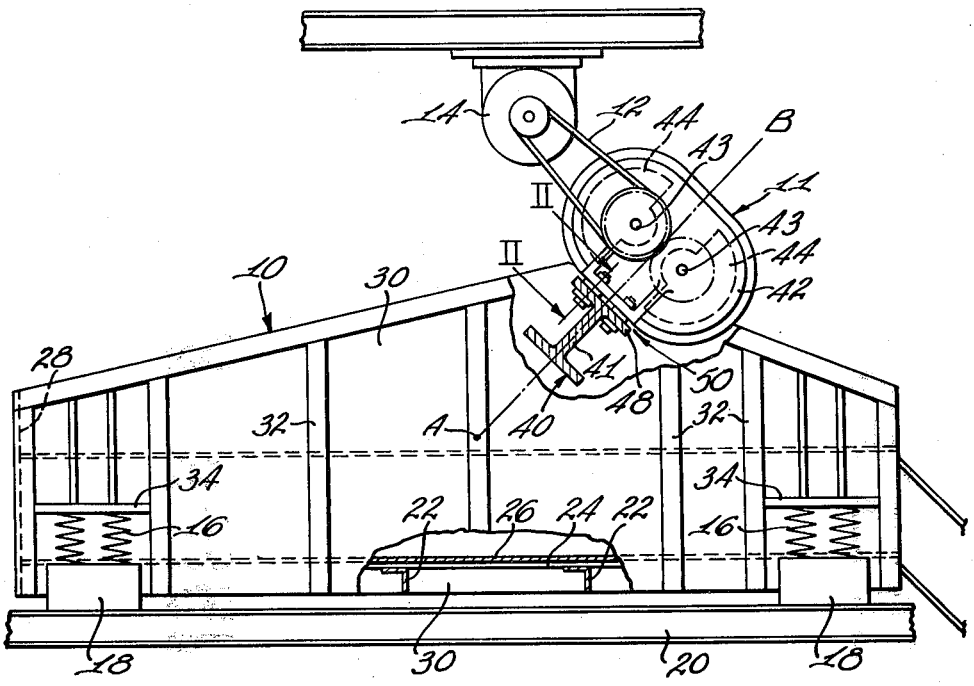
FIG. 1 is an elevation view of a vibrating screen incorporating an embodiment of the invention.

Referring to FIG. 1 of the drawing, a freely floating vibratable screen body 10 for particulate material is provided with a suitable power driven vibrating mechanism 11 attached to the screen body. Shaker drive mechanism 11 is preferably of the rotatable eccentric mass type substantially as described in Lincoln et al U.S. Pat. No. 2,144,382 and is arranged to be driven at substantially constant frequency by a belt 12 from a driving motor 14. Shaker drive mechanism 11 generates periodic inertia force impulses in line with the center of gravity A of screen body 10 and mechanism 11, which force impulses tend to move screen body 10 and mechanism 11 in a straight line path of direction indicated by line A–B. However, my invention is also applicable to screens provided with vibrator drive mechanisms having an elliptical path whose major axis is in a direction indicated by line A–B, and is also applicable to vibrator drive mechanisms having a circular path.

Screen body 10 may be freely and yieldingly supported in a substantially horizontal position by resilient coil mounting springs 16 the lower ends of which rest on suitable feet 18 which may be on the ground or be affixed to a stationary base frame support 20. Mounting springs 16 isolate base frame 20 from vibrations of screen body 10.

Screen body 10 may comprise a lattice frame of transverse cross members 22 welded to longitudinal support bars 24 carrying one or more screen decks 26. Screen body 10 may have substantially parallel end plates 28 and may also have substantially parallel spaced side plates 30 with vertical stiffener, or reinforcing members 32 welded thereto. Side plates 30 may be provided at spaced points with laterally projecting mounting flanges 34 that abut against the upper end of coil mounting springs 16. A steel cross I-beam support 40 is secured at its ends to side plates 30 and increases the rigidity of screen body 10 and supports vibrating drive mechanism 11 on the screen body. In a known manner, I-beam support 40 is disposed with its web 41 in line with the rectilinear force exerted by vibrating mechanism 11 along line A–B so that the longitudinal center line of the support member (i.e., web 41) which transmits the vibratory force to the screen body 10 passes substantially through the center of gravity of the screen body and of drive mechanism 11 and assures that all parts of screen body 10 are reciprocated equally. As disclosed in aforementioned Lincoln et al patent U.S. Pat. No. 2,144,382, shaker drive mechanism 11 may comprise a housing 42 having two parallel shafts 43 mounted therein carrying eccentrically positioned weights, or masses 44 which rotate in unison in opposite directions to generate the reciprocatory vibratory motion that is imparted to the screen body 10. The weights 44 are so fixed on their respective shafts that the resultant of the centrifugal force caused by their rotation will always be along the line A–B perpendicular to the plane passing through the axis of shafts 43.

Vibrating mechanism 11 exerts a force which varies between zero and two maxima in opposite directions and is always directed along line A–B. The magnitude of this force has a sinusoidal variation. Inasmuch as vibrating mechanism 11 is mounted on screen body 10, the vibrating mechanism 11 imparts a sinusoidal rectilinear force to screen body 10 which is in a direction along line A–B, shown as approximately 45° to the horizontal. Since screen body 10 is freely supported on springs 16, the movement of screen body 10 upwardly to the right carries its load of material with it, after which it returns against the coil springs 16, which then tend to return screen body 10 to its position of rest. The four forces acting on screen body, namely the force of gravity, the rectilinear force of vibrator 11, the reaction force of support coil springs 16, and the inertia of screen body 10, combine in known manner to produce a linear pulsating reciprocation of screen body 10. Vibratory drive mechanism 11 is operated at a substantially constant shaker frequency which is substantially higher than the natural vibratory frequency, known as the torsional rocking frequency, of screen body 10 so yieldably supported on springs 16.

Figures 4A, 4B:
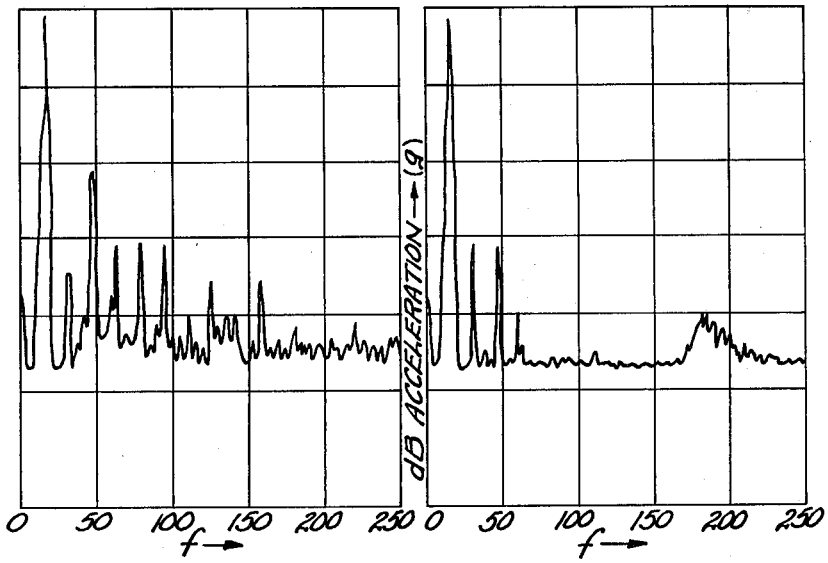
FIGS. 4A and 4B illustrate frequencies of the shaker drive which are transmitted to the screen body respectively with and without the resilient mounting means for the shaker drive disclosed in FIGS. 1 and 2.

I have discovered that vibratory drive mechanism 11 is one source of forced vibration which excites the end walls 28 and side walls 30 of screen body 10 into resonance and causes them to radiate noise which appreciably raises the noise level of the screen. The components of drive mechanism 11 are not the major sources of such radiated noise, but the harmonics of the fundamental drive mechanism frequency are generated because the input force is not perfectly sinusoidal and are transmitted along support beam 40 which is fastened to side walls 30 and excite the wall panels of screen body 10 into resonance. FIG. 4A illustrates the frequency spectrum of the acceleration forces imparted to screen body 10 when drive mechanism 11 is rigidly affixed thereto. It will be noted that high magnitudes of harmonics of the vibrator fundamental frequency are present up to very high orders of harmonics.

Figure 3:
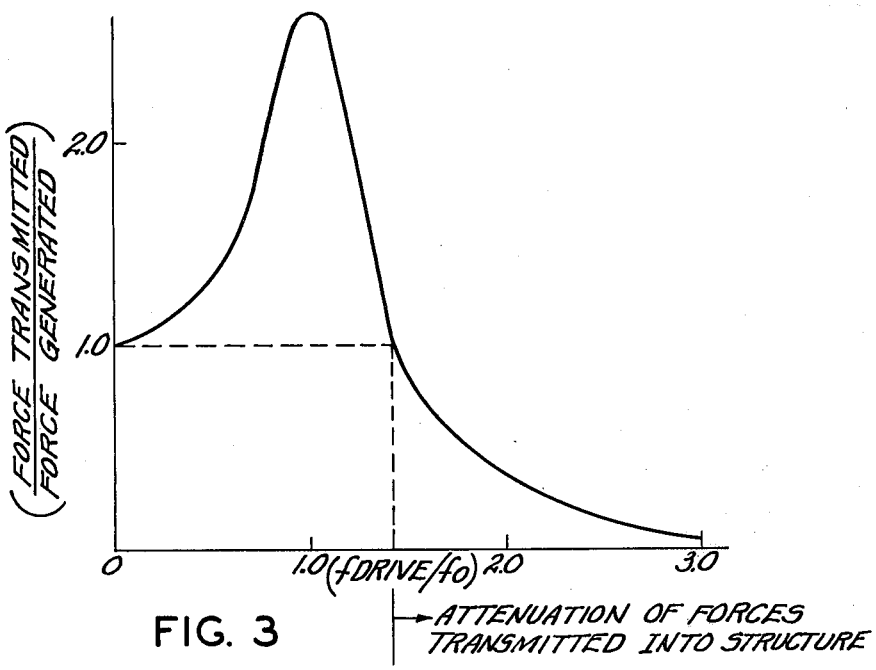
FIG. 3 is a graph schematically illustrating harmonic shaker frequencies which are theoretically attenuated by the invention.

In accordance with the invention, vibratory drive mechanism 11 is resiliently mounted on screen body 10 in such a manner that the fundamental frequency is transmitted unrestrained to screen body 10 while the harmonics thereof are attenuated, thereby minimizing noise radiated from the side and end panels of screen body 10. Drive mechanism 11 is supported on flange 48 of I-beam 40 by resilient mounting means 50 the natural vibratory frequency of which is equal to approximately the constant operating frequency of drive mechanism divided by $\sqrt{2}$, and such resilient mounting means constitute substantially the sole connection between the drive mechanism 11 and screen body 10. FIG. 3 schematically illustrates the theoretical characteristics of such resilient mounting means 50 and shows that the ratio of the force transmitted thereby to the driving force is equal to unity when the ratio of the drive frequency f to the natural vibratory frequency $f_o$ of the resilient vibration isolator mounting means is approximately equal to $\sqrt{2}$ and also that the former ratio decreases rapidly when the latter ratio increases above $\sqrt{2}$.

Figure 2:
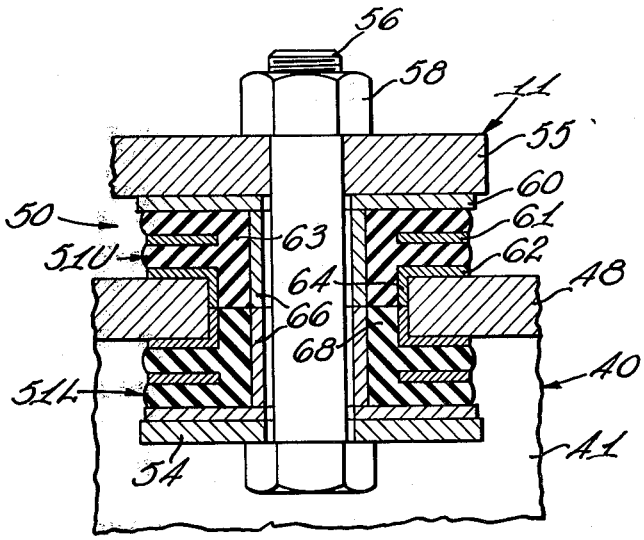
FIG. 2 is a view taken along line II—II of FIG. 1 and illustrating a preferred form of resilient mounting means.

The specific form of vibration isolator resilient mounting means 50 having a predetermined natural vibratory frequency does not constitute part of the present invention. It is well known that the natural vibratory frequency varies with the stiffness constant k (spring constant), and such vibration isolators are commercially available from many sources. FIG. 2 illustrates one form of commercially available vibration isolator having such characteristics comprising laminated isolator pads 51 of elastomeric material such as natural rubber disposed on both sides of the I-beam flange 48 so that upper isolator pad 51U is compressed when the inertia impulse force from vibratory drive mechanism 11 is downward and lower isolator pad 51L is compressed when the inertia impulse force is upward. A support plate 54 is disposed on the side of flange 48 opposite the base 55 of drive mechanism 11, and a threaded bolt 56 extends through clearance holes in the support plate 54, in the upper and lower isolator pads 51L and 51U, in flange 48 and in drive mechanism base 55 and engages a nut 58 which is tightened on bolt 56 to compress upper pad 51U between base 55 and one side of flange 48 and also compress lower pad 51L between support plate 54 and the other side of flange 48. It will be appreciated that, alternatively, bolts 56 can be engaged within threaded holes in base 55 of drive mechanism 11. Pads 51U and 51L are of T-shaped cross section and are positioned so that the tubular stem portions of 51U and 51L abut within the clearance aperture in flange 48. Each pad 51 may comprise three metallic lamina 60, 61 and 62 disposed in parallel planes with elastomeric rubber material therebetween and may be bonded to the rubber material 63. Lamina 62 abuts flange 48 and may have a tubular lip 64 which extends into the clearance aperture in flange 48. Each pad 51 also has a tubular metallic member 66 extending along the stem of its T-shape cross section, and such tubular metallic members 66 on pads 51U and 51L abut to limit the degree of compression of the rubber material 63. Each pad 51U and 51L also has a tubular portion 68 of elastomeric material disposed between lip 64 and tubular metallic member 66 which is compressed by any vibratory forces from drive mechanism 11 having a component perpendicular to line A–B. The aforementioned Lincoln et al patent discloses that the path of the vibratory forces from drive mechanism 11 may be selectively varied to an ellipse or a circle as desired by changing the position of weights 44 on shafts 43, and it will be appreciated that isolator pads 51U and 51L attenuate forces in directions along three mutually perpendicular axes and will also minimize the vibratory forces at harmonics of shaker frequency transmitted to screen body 10 when the path of the inertia impulse forces are circular or elliptical.

Nut 58 is preferably tightened on bolt 56 to pre-load isolator pads 51U and 51L in compression against flange 48 so that the fundamental drive frequency is transmitted in push-pull without substantial attenuation to screen body 10. It will be appreciated that a plurality of mechanically coupled drive mechanisms 11 may be so resiliently mounted on beam 40 and operated in phase synchronization to increase the total inertia impulse force on screen body 10, and further that isolator pads 51U and 51L are interposed between flange 48 and drive mechanism 11 on both sides of line A–B and a plurality of sets of such isolator pads 51L and 51U are utilized to mount such drive mechanisms 11 on flange 48.

The embodiments of the invention in which an exclusive property or privilege is claimd are defined as follows:

1. A vibrating screen comprising, in combination, a screen body for moving particulate material and being mounted for vibratory movement, rotatable eccentric mass drive means for vibrating said screen body at a substantially constant frequency which is substantially higher than the natural vibration frequency of said screen body and means for resiliently mounting said drive means on said screen body so that vibratory forces emanating at approximately the fundamental component of said constant frequency from said drive means are transmitted unrestrained to said screen body and vibratory forces which are at harmonics of the fundamental component of said constant frequency are substantially attenuated, said mounting means constituting substantially the sole connection between said drive means and said screen body and the natural vibratory frequency of said resilient mounting means being approximately equal to said constant frequency divided by $\sqrt{2}$.

2. A vibrating screen comprising, in combination, a generally rectangular vibratory screen body for moving particulate material and being mounted for vibratory movement, said screen body having substantially parallel sidewalls and a cross I-beam extending between said sidewalls so that the longitudinal axis through the web of said beam is directed through the center of gravity of said screen body, rotatable eccentric mass drive means for vibrating said screen body along a path whose major axis is coincident with said longitudinal axis through the web of said beam at a substantially constant frequency which is substantially higher than the natural vibration frequency of said screen body, and means for resiliently mounting said drive means on a flange of said beam so that vibratory forces emanating at approximately the fundamental component of said constant frequency from said drive means are transmitted unrestrained to said flange and those which are at harmonics of the fundamental component of said constant frequency are substantially attenuated, said mounting means constituting substantially the sole connection between said drive means and said screen body and the natural vibratory frequency of said mounting means being approximately equal to said constant frequency divided by $\sqrt{2}$.

3. A vibrating screen in accordance with claim 1 wherein said screen body includes substantially parallel spaced sidewalls and a cross support member affixed at its ends to said sidewalls, said mounting means affixes said drive means to said support member and includes elastomeric isolator pads on opposite sides of said support member, and said drive means generates pulsating reciprocatory forces in opposite directions which compress said isolator pads on opposite sides of said support member to vibrate said screen body.

4. A vibrating screen in accordance with claim 1, 3 or 2 wherein the throw of said screen body so driven by forces from said drive means transmitted through said resilient mounting means is approximately equal to the throw of said drive means.

5. A vibrating screen in accordance with claim 1, 3 or 2 wherein said drive means vibrates said screen body along a straight-line path.

6. A vibrating screen in accordance with claim 2 wherein said mounting means includes elastomeric isolator pads on opposite sides of said flange and said drive means generates pulsating reciprocatory forces in opposite directions which compress said isolator pads on opposite sides of said flange alternately to drive said screen body.

7. A vibrating screen in accordance with claim 6 wherein bolt means extending through clearance apertures in said flange affix said drive means to said screen body, and one said isolator pad is compressed between said drive means and one side of said flange and another said isolator pad is compressed between the opposite side of said flange and the head of said bolt means.

8. A vibrating screen in accordance with claim 1, 2 or 6 wherein said resilient mounting means attenuates vibratory forces emanating from said drive means directed along three mutually perpendicular axes.

* * * * *